US006644922B2

(12) United States Patent
McCallum et al.

(10) Patent No.: US 6,644,922 B2
(45) **Date of Patent: *Nov. 11, 2003**

(54) VARIABLE PITCH FAN

(75) Inventors: Jonathan E. McCallum, Edmonton (CA); Brian J. Bruchal, Edmonton (CA); Murray C. Gerwing, Edmonton (CA)

(73) Assignee: Flexxaire Manufacturing Inc., Edmonton (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/225,507

(22) Filed: Aug. 21, 2002

(65) Prior Publication Data

US 2002/0192078 A1 Dec. 19, 2002

Related U.S. Application Data

(63) Continuation of application No. 09/602,604, filed on Jun. 21, 2000, now Pat. No. 6,439,850, which is a continuation-in-part of application No. 09/116,518, filed on Jul. 16, 1998, now Pat. No. 6,113,351.

(30) Foreign Application Priority Data

Jul. 15, 1998 (CA) ..... 2243151
Jun. 22, 1999 (DE) ..... 199 28 536

(51) Int. Cl.[7] ..... F04D 29/18
(52) U.S. Cl. ..... 416/156; 416/44
(58) Field of Search ..... 416/44, 47, 48, 416/27, 30, 144, 155, 156, 157 R, 158, 162, 163, 164, 166, 167, 168 R, 139

(56) References Cited

U.S. PATENT DOCUMENTS 2,644,536 A 7/1953 Kelley
2,693,242 A 11/1954 Elmer (List continued on next page.)

FOREIGN PATENT DOCUMENTS

EP 0 413 663 A2 2/1991

(List continued on next page.)

OTHER PUBLICATIONS

Abstract of U.S. Patent No. 5,029,091, Schneider et al., Jul. 2, 1991, 1 page.
Abstract of U.S. Patent No. 5,282,719, McCarty, et al., Feb. 1, 1994, 2 pages.
Abstract of U.S. Patent No. 4,772,179, Bennett et al., Sep. 20, 1988, 2 pages.
Abstract of U.S. Patent No. 4,958,289, Sum et al, Sep. 18, 1990, 2 pages.

(List continued on next page.)

*Primary Examiner*—John Kwon
(74) *Attorney, Agent, or Firm*—Christensen O'Connor Johnson Kindness PLLC

(57) ABSTRACT

A variable pitch fan in which the pitch of the fan blades is varied under control of a controller according to the speed of the fan. The controller is programmed to respond to increased fan speed by decreasing pitch of the fan blades. The variable pitch fan has a piston extending axially from a main shaft, about which main shaft a fan blade hub rotates. A pitch shifter is mounted on a cylinder, which itself is mounted on the piston. The pitch shifter is actuated by hydraulic fluid supplied through the main shaft to the cylinder. The piston is preferably axially stationary in relation to the main shaft. The cylinder is secured against rotational movement by cooperating out of round surfaces. Grease for the pitch shifter is supplied through the guide pin. One guide pin may be used for grease supply, while another may be used for excess grease return. Cooling of a pitch shifter may be accomplished using a heat sink mounted within the fan hub, preferably in a fan configuration, to conduct heat away from the cylinder into air rotating within the fan hub. Counterweights are mounted on each fan blade of a variable pitch fan, preferably hydraulically actuated, in a position which generates a torque opposite in direction to torque generated by the fan blades. The counterweights may be overbalanced, underbalanced, or balanced.

14 Claims, 9 Drawing Sheets

U.S. PATENT DOCUMENTS

| | | | |
|---|---|---|---|
| 3,217,808 | A | 11/1965 | Elmer |
| 3,501,251 | A | 3/1970 | Haglund et al. |
| 3,536,415 | A | 10/1970 | Kusiak |
| 3,560,108 | A | 2/1971 | Lindahl |
| 3,763,835 | A | 10/1973 | Miller et al. |
| 3,792,937 | A | 2/1974 | Chilman |
| 4,037,986 | A | 7/1977 | Chilman |
| 4,047,842 | A | 9/1977 | Avena et al. |
| 4,049,363 | A | 9/1977 | Baumann et al. |
| 4,221,541 | A | 9/1980 | Bianchi |
| 4,461,340 | A | 7/1984 | Hart et al. |
| 4,485,888 | A | 12/1984 | Yu |
| 4,641,039 | A | 2/1987 | Carre |
| 4,671,736 | A | 6/1987 | Finnigan |
| 4,717,312 | A | 1/1988 | Seeley |
| 4,778,344 | A | 10/1988 | Water |
| 4,920,929 | A | 5/1990 | Bishop |
| 4,934,901 | A | 6/1990 | Duchesneau |
| 5,022,821 | A | 6/1991 | Isert |
| 5,061,212 | A | 10/1991 | Morgenthaler et al. |
| 5,122,034 | A | 6/1992 | Isert |
| 5,209,640 | A | 5/1993 | Moriya |
| 5,224,446 | A | 7/1993 | Okita et al. |
| 5,284,418 | A | 2/1994 | Moriya |
| 5,299,911 | A | 4/1994 | Moriya |
| 5,415,523 | A | 5/1995 | Muller |
| 5,431,539 | A | 7/1995 | Carvalho |
| 5,451,141 | A | 9/1995 | Carvalho et al. |
| 5,464,324 | A | 11/1995 | Langenberg |
| 5,564,899 | A | 10/1996 | Na |
| 5,810,560 | A | 9/1998 | Tanaka |
| 5,836,743 | A | 11/1998 | Carvalho et al. |
| 6,113,351 | A | 9/2000 | McCallum et al. |
| 6,439,850 | B1 * | 8/2002 | McCallum et al. ..... 416/144 |

FOREIGN PATENT DOCUMENTS

| | | |
|---|---|---|
| EP | 0 945 626 A2 | 9/1999 |
| GB | 1065582 | 4/1967 |
| GB | 1114934 | 5/1968 |
| GB | 1149130 | 4/1969 |
| GB | 1274677 | 5/1972 |
| GB | 2 022 534 A | 12/1979 |
| GB | 2 151 712 A | 7/1985 |
| GB | 2 257 480 A | 1/1993 |
| WO | WO 86/04385 A1 | 7/1986 |
| WO | WO 98/22340 A1 | 5/1998 |
| WO | WO 98/44242 | 10/1998 |
| WO | WO 99/20522 A1 | 4/1999 |

OTHER PUBLICATIONS

Abstract of U.S. Patent No. 5,019,006, Schneider et al., May 28, 1991, 1 page.

Abstract of U.S. Patent No. 5,061,212, Morgenthaler et al., Oct. 29, 1991, 1 page.

Abstract of U.S. Patent No. 5,205,712, Hamilton, Apr. 27, 1993, 2 pages.

Isert Fan Thermostatic Pitch Controller Technical Manual, Published Alberta, Canada, Jul. 1990. Sales of the product described herein occurred in the United States at least as early as Apr. 1993.

Photocopy of Canadian Patent Application No. 2,170,226, filed Feb. 23, 1996 (published Aug. 24, 1997), including drawings and filing certificate (13 pages).

* cited by examiner

DETERMINE AIR FLOW REQUIREMENT
30
32
DETERMINE REQUIRED BLADE PITCH
DETERMINE RPM AND FAN PITCH
34
36
COMPARE REQUIRED PITCH WITH CURRENT PITCH
38
DECREASE PITCH
NO CHANGE
INCREASE PITCH

VARIABLE PITCH FAN

CROSS-REFERENCES TO RELATED APPLICATIONS

This application is a continuation of prior application Ser. No. 09/602,604, filed Jun. 21, 2000 now U.S. Pat. No. 6,439,850, which was a continuation-in-part of application Ser. No. 09/116,518, filed Jul. 16, 1998, now U.S. Pat. No. 6,113,351.

FIELD OF THE INVENTION

This invention relates to variable pitch fans.

BACKGROUND OF THE INVENTION

Flexxaire Manufacturing Inc. makes a variable pitch fan for use on engines, such as engines made by Caterpillar Inc. of Peoria, Ill., USA. A goal of variable pitch fan design is to provide a variable pitch fan which is lightweight, reliable, and which provides accurate and rapid adjustment of fan. There are various variable pitch fans known, as for example those described in U.S. Pat. Nos. 5,564,899; 5,022,821; and 5,122,034. It is an object of the invention to provide improved operating features for variable pitch fans.

SUMMARY OF THE INVENTION

There is thus provided, in accordance with an aspect of the invention, a variable pitch fan, which has a piston extending axially from a main shaft, about which main shaft a fan blade hub rotates. A pitch shifter is mounted on a cylinder, which itself is mounted on the piston. The pitch shifter is actuated by hydraulic fluid for example supplied through the main shaft to the cylinder. The piston is preferably axially stationary in relation to the main shaft. Relative rotational movement between the piston and cylinder is prevented by use of a stop, by using out of round surfaces, as for example a hexagonal surface on one of the piston and cylinder.

According to a further aspect of the invention, a portion of the main shaft forms the other of the piston shaft and cylinder. According to a further aspect of the invention, the main shaft has a bore defining the cylinder, and the out of round exterior surface on the piston shaft is received by an out of round surface in the main shaft. The housing may be mounted for rotational movement on the main shaft on bearings, and lubrication for the bearings may be delivered by a passageway through the piston shaft.

According to a further aspect of the invention, there is provided a pully hub mounted together with the housing for rotation on the main shaft.

In a further improvement of variable pitch fans, counterweights, which are known in themselves for use on aircraft propellers, are mounted on each fan blade of a variable pitch fan, preferably hydraulically actuated, in a position which generates a torque opposite in direction to torque generated by the fan blades. The counterweights may be overbalanced, underbalanced, or balanced.

These and other aspects of the invention are described in the detailed description of the invention and claimed in the claims that follow.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 9 is a section through a variable pitch fan with a hexagonal piston shaft.

DETAILED DESCRIPTION OF THE PREFERRED EMBODIMENT

Figure 1:
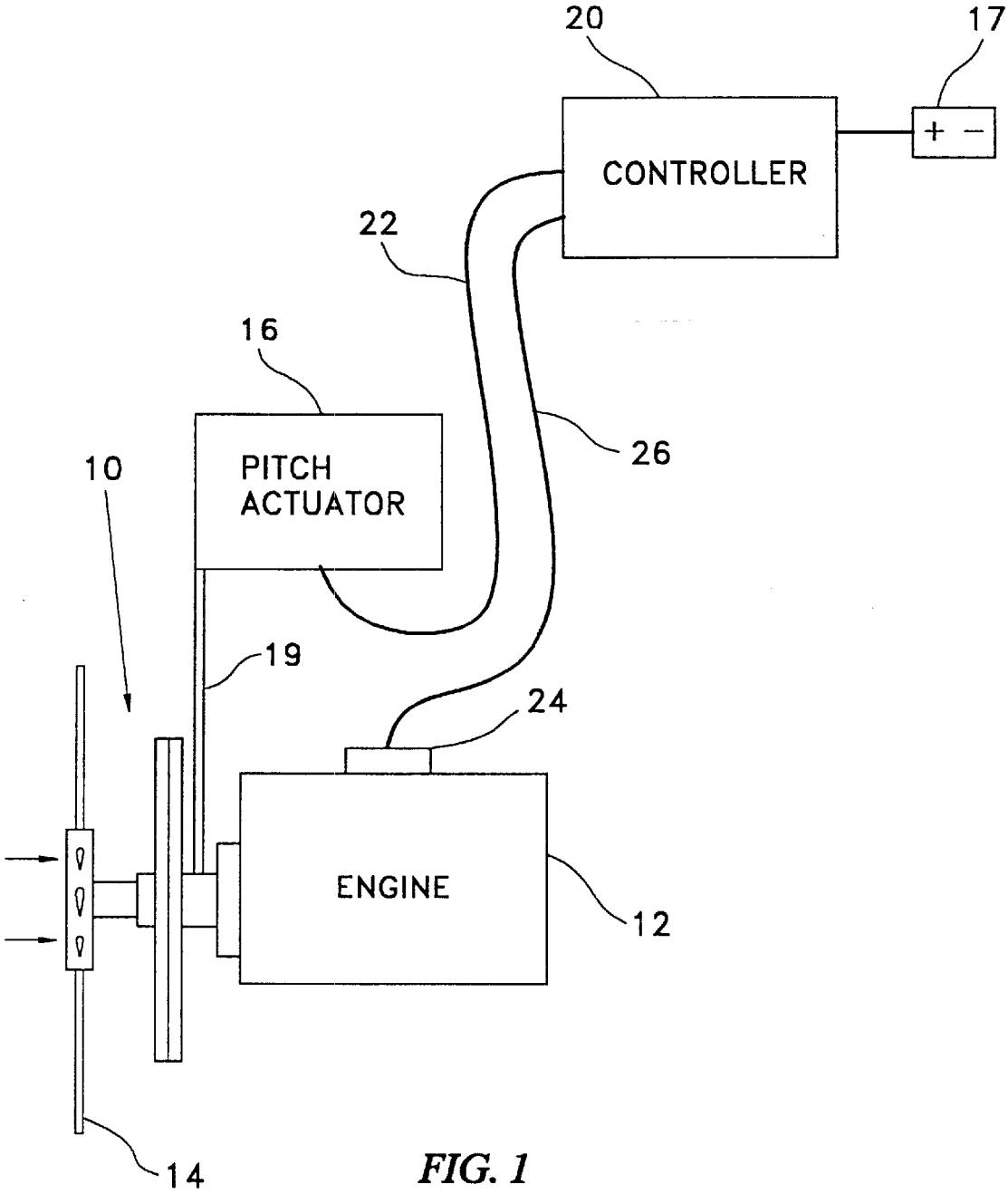
FIG. 1 is a schematic of a variable pitch fan assembly with pitch actuator and controller.

Referring to FIG. 1, an engine 12 and variable pitch fan assembly 10 are positioned within an engine compartment of vehicle, for example a piece of heavy wheeled or tracked equipment. Variable pitch cooling fan 10 with its blades 14 is disposed within the engine compartment and attached to engine 12. The blades 14 of cooling fan 10 have a plurality of blade positions, including a push position (reverse blade position), pull position (conventional or normal position) and neutral position in which the rotation of the blades continues and blocks air flow (air block effect). The pitch of the blades 14 may be varied in small angular increments by actuator 16. A controller 20 is coupled to cooling fan 10 by means of a communications link 22 (for example a cable) which connects to actuator 16 and serves to adjust the positioning of fan blades 14 by providing signals to the actuator 16 along link 22. A conventional speed or rpm sensor 24 is provided on the engine for sensing the engine RPM. Sensor 24 is coupled to controller 20 by means of a further communications link such as cable 26. Controller 20 receives power from battery 17. The pitch actuator 16 is connected to the fan 10 by hydraulic supply lines 19.

Figure 2:
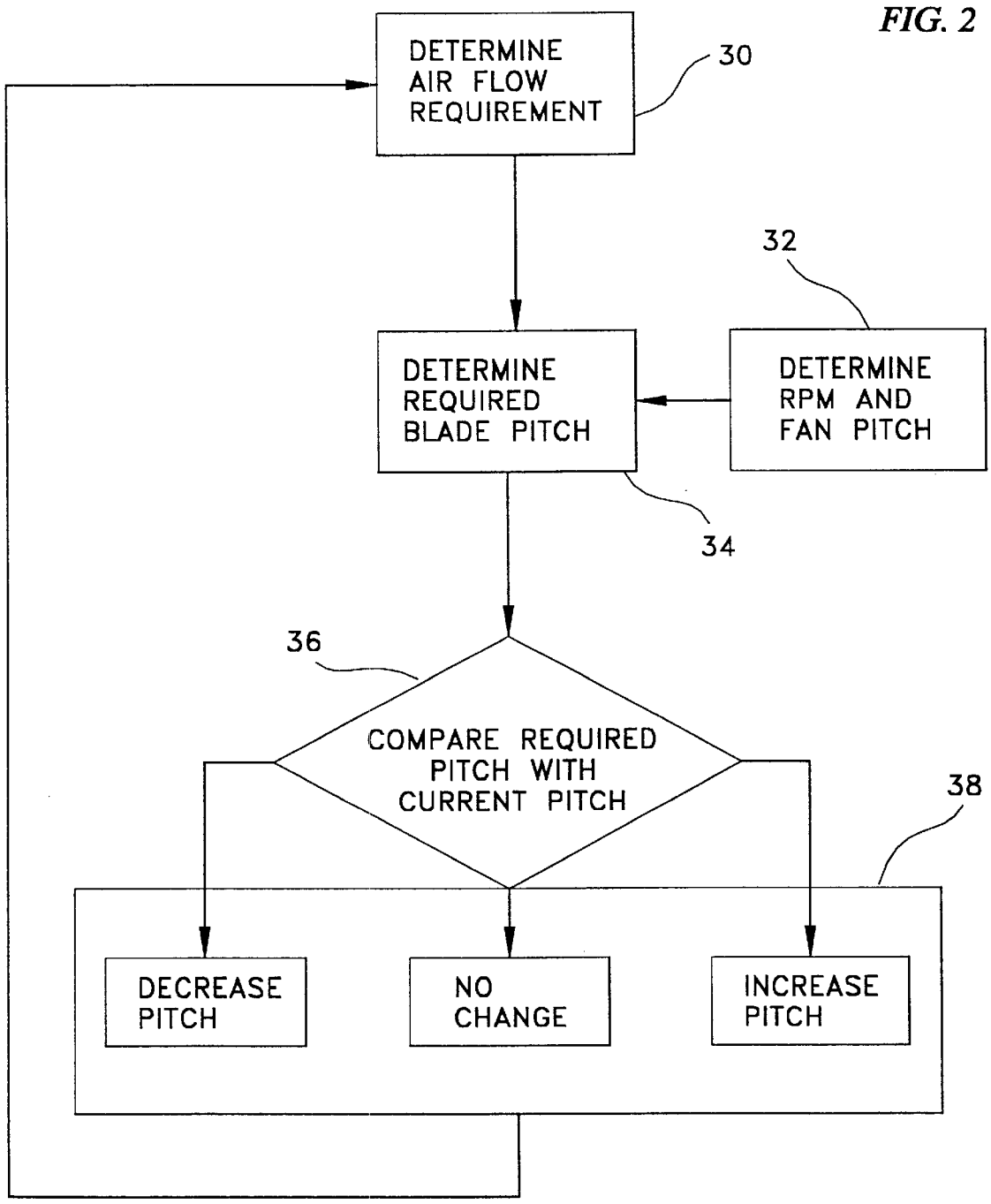
FIG. 2 is a flow diagram showing operation of a controller for controlling pitch in accordance with RPM.

Referring to the flow diagram in FIG. 2, the controller 20 works as follows. Air flow requirement is determined initially at 30 from various conventional sensors of cooling requirement such as engine coolant temperature, intake air temperature, hydraulic oil temperature, transmission oil temperature, brake coolant temperature, pressure or AC condenser temperature or any other sensor that indicates a cooling load. This is known in the art. Flexxaire Manufacturing Ltd. of Edmonton, Canada, has for example provided a variable pitch fan assembly with thermostatic pitch controller that controls the pitch of the fan dependent upon engine temperature since at least as early as 1990. Unlike previous fans, the present fan also decreases fan pitch in response to increased measured RPM as determined by the RPM sensor 24. RPM is sensed in step 32. This RPM sensor 24 senses the speed of the engine. However, it is equivalent to a fan speed sensor since the engine speed directly controls the fan speed (due to a direct belt and pulley connection).

Given the cooling requirements determined by the various conventional temperature and/or pressure sensors in step 30, the controller 20 calculates in step 34 the total air flow and hence required pitch to cool the engine at the current RPM. The determined pitch is then compared with the actual pitch in step 36. If the pitch is too low, it is increased, if too high, it is decreased, otherwise it is left the same. Pitch is increased or decreased in step 38 by manipulating hydraulic solenoid valves in the pitch actuator 16. The pitch actuator 16 is formed of a conventional hydraulic supply controlled by solenoid valves. The solenoid valves are controlled by signals from the controller 20.

By being able to control pitch based on RPM, the present device is able to clip the pitch at high RPM. This saves horsepower and is better than a clutched fan because a slipping clutch inherently wastes energy, and also reduces sound due to the lower air flow. Maximum air flow may then be obtained at lower engine (fan) speeds without clutch slipping losses.

Figure 3:
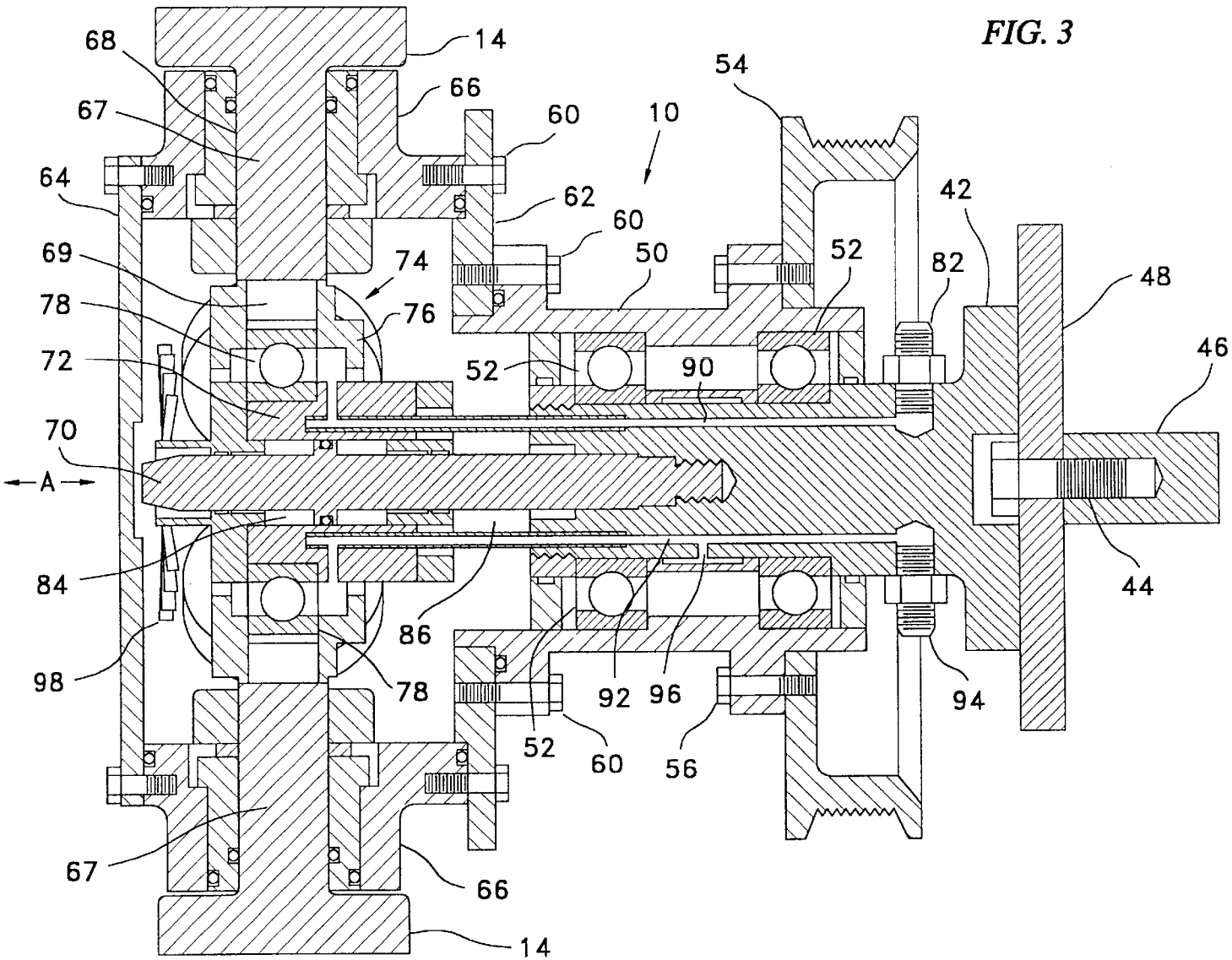
FIG. 3 is a first cross-section through a hydraulically actuated variable pitch fan with stationary piston showing grease galleries.
Figure 4:
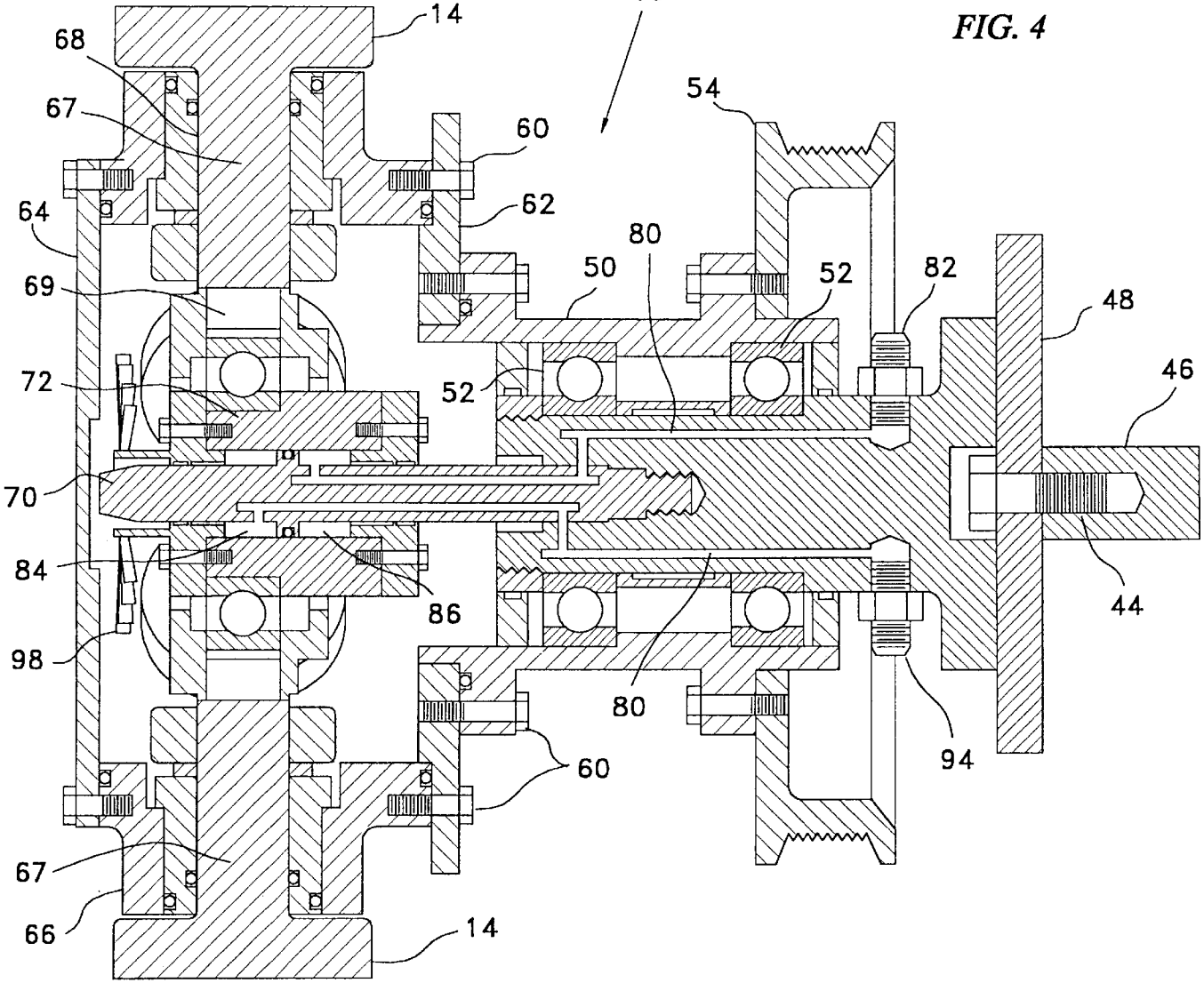
FIG. 4 is a second cross-section of the variable pitch fan shown in FIG. 4 showing hydraulic supply lines.
Figure 5:
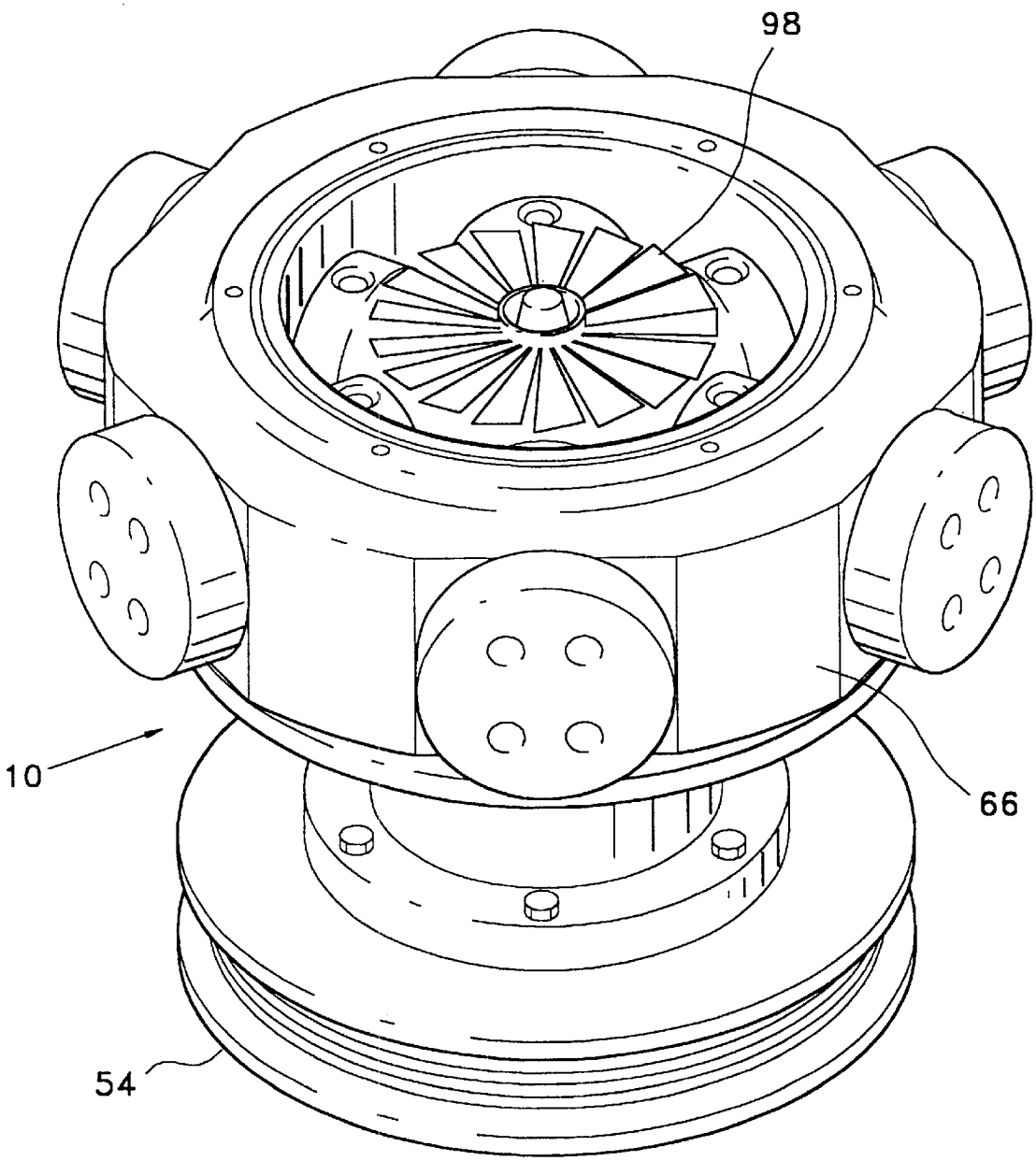
FIG. 5 is a perspective of the variable pitch fan shown in FIGS. 3 and 4.

Referring now to FIGS. 3–5, a variable pitch fan 10 has a main shaft 42 with an axis A. At one end of the main shaft 42 is a mechanism for securing the fan 10 to a vehicle using bolt 44 embedded in a recess 46. The bolt 44 threads into a nut 46 and is used to secure the fan 10 to a wall 48 of an engine compartment 12. A cylindrical flanged housing 50 is rotatably mounted on the main shaft 42 with main shaft bearings 52. A pulley hub 54 is secured to the cylindrical flanged housing 50 with bolts 56 or other suitable means. A fan hub 58 is secured to the cylindrical flanged housing 50 with bolts or other suitable means, the fan hub 58, pulley hub 54 and housing 50 rotate together on the main shaft 42. The fan hub 58 is formed of an annular plate 62, circular plate 64 and cylindrical fan blade housing 66 secured between the annular plate 62 and circular plate 64. A number of fan blades 14, for example six, extend radially from the fan hub 58. The fan blades 14 are mounted to rotate about the fan blade long axis with fan blade shafts 67 received within bores 68 formed in the fan hub 58. The fan blade shafts 67 terminate inwardly with axially offset shifter pins 69. Suitable seals and bearings are used to permit the fan blades 14 to rotate in bores 68 and thus change or adjust pitch of the fan blades 14.

A piston 70 extends axially (along axis A) from the main shaft 42. In the embodiment shown in FIGS. 3 and 4, the piston 70 is fixed stationary to the main shaft 42. A double acting cylinder 72 is mounted on the piston 70. The cylinder 72 shown in FIGS. 3 and 4 is slidably mounted to allow for relative axial movement between the piston and cylinder. In the instance shown, the cylinder moves in relation to the piston 70. A pitch shifter 74 is mounted on the cylinder 72. The pitch shifter 74 is formed of a pair of parallel plates 76 mounted on pitch shifter bearings 78. The pitch shifter 74 interconnects the cylinder 72 and the fan blades 14 to convert axial movement of the cylinder 72 to a pitch change of the fan blades 14. Referring to FIG. 4, hydraulic lines 80 pass through the main shaft 42 from a hydraulic supply fitting 82 to both chambers 84 and 86 of double acting cylinder 72. The piston 70, cylinder 72, pitch shifter 74, bearings 78 and pins 69 together form a pitch shifter mechanism for the pitch adjustable fan blades 14.

In operation, the cylinder 72 is driven axially back and forward on the piston 70 by hydraulic fluid delivered from the pitch actuator 16 (FIG. 1). Preferably, neither the piston 70 nor the cylinder 72 rotate with the fan hub 58. The pitch shifter 74 rotates with the fan hub 58 and translates with the movement of the cylinder 72. As the pitch shifter 74 is driven axially by the cylinder 72, the pins 69 are also driven axially, which forces the blades 14 to rotate and adjust the pitch of the fan blades 14.

As shown in FIGS. 3 and 4, the cylinder 72 is secured against rotational movement by at least one guide pin, here shown as two pins 88, passing from the cylinder 72 into the main shaft 42. Referring to FIG. 3, a grease gallery 90 is provided in the main shaft 42 extending from the fitting 82 and interconnecting with the pitch shifter bearings 78 through at least one of the guide pins 88. A second grease gallery 92 extends from the shifter bearings 78 through the other of the guide pins 88 to fitting 94. A port 96 in the gallery 92 allows excess grease from the shifter bearings 78 to lubricate the main shaft bearings 52.

A heat sink formed of aluminum fan shaped air deflectors 98 is mounted within the fan hub 58 on the cylinder 72 to conduct heat away from the cylinder 72 into the air rotating within the fan hub.

Figure 6:
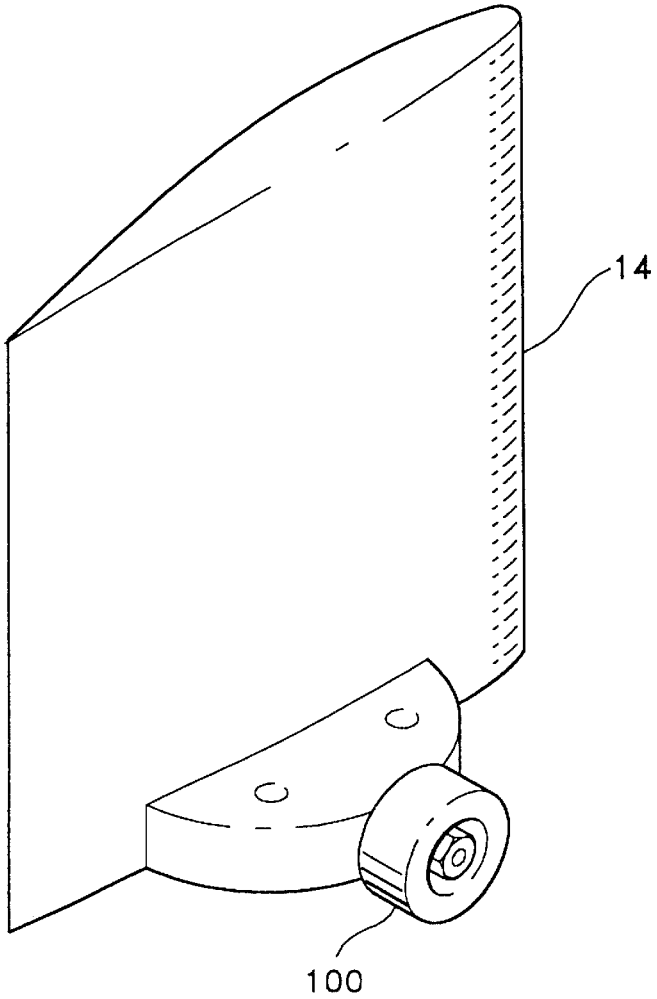
FIG. 6 is a perspective view of a fan blade with counterweights.
Figure 7:
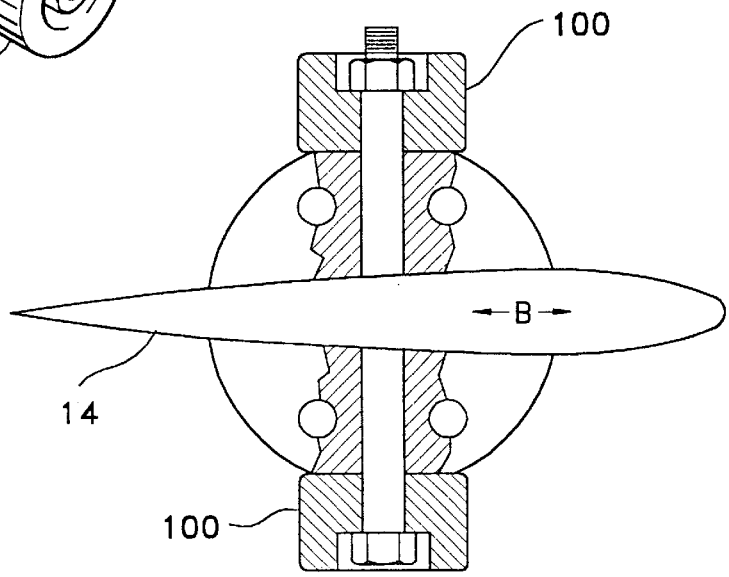
FIG. 7 is a section through a fan blade with counterweights as shown in FIG. 6.

Referring now to FIGS. 6 and 7, counterweights 100 are mounted on each fan blade 14 in a position which generates a torque opposite in direction to torque generated by the fan blades 14. Each fan blade 14 has a chord B and the counterweights 100 are mounted perpendicular to the chord B on either side of the fan blade 14. The weight of the counterweights 100 may be selected to underbalance, balance or overbalance the blades 14. Due to the shape of a fan blade 14, the centrifugal forces produced when the fan hub 58 spins generates a torque on the fan blades 14 which tends to force the fan blades 14 to a neutral pitch. This force increases with the square of the RPM and is related to the shape and mass of the blade according to known principles in the art of making aircraft propeller blades. By varying the size and placement of the counterweights, the weights may be underbalanced, balanced, or overbalanced, corresponding to whether the torque generated by the counterweights is less than, equal to or greater than the torque generated by the blades. In the underbalanced condition, there is a net torque driving the blades to neutral pitch and in the overbalanced condition, there is a net torque driving the blades to full pitch.

In the underbalanced condition, the counterweights reduce the force required to hold the blades in full pitch, but at the same time keep the weights below the balance point, so that the blades default to neutral pitch. This is useful for open loop control systems. Without sensors, neutral pitch is unattainable if the blades are balanced or overbalanced. By keeping the blades underbalanced, neutral pitch can be achieved simply by removing positioning control and letting the blades rotate freely. In hydraulic applications, this is achieved simply by equalizing the pressure on each side of the piston. A simple control system can then achieve full pitch in either direction depending on which side of the piston receives the high pressure fluid, and can achieve neutral pitch by equalizing the pressure on each side of the piston, i.e., by using simple valving.

In the balanced condition, the force required to hold the blades in any pitch can be dropped effectively to zero. Balanced blades require the lowest pitch adjustment forces, and thus smaller components, and in the case of hydraulic systems, lower operating pressure.

In the overbalanced condition, the blades drive into pitch. This is advantageous in that the fan then defaults to full pitch in case of shifter mechanism failure. For the hydraulic fan, if a leak occurred or hydraulic pressure failed, the fan defaults to full pitch and a potential over heat condition can be avoided.

Figure 8:
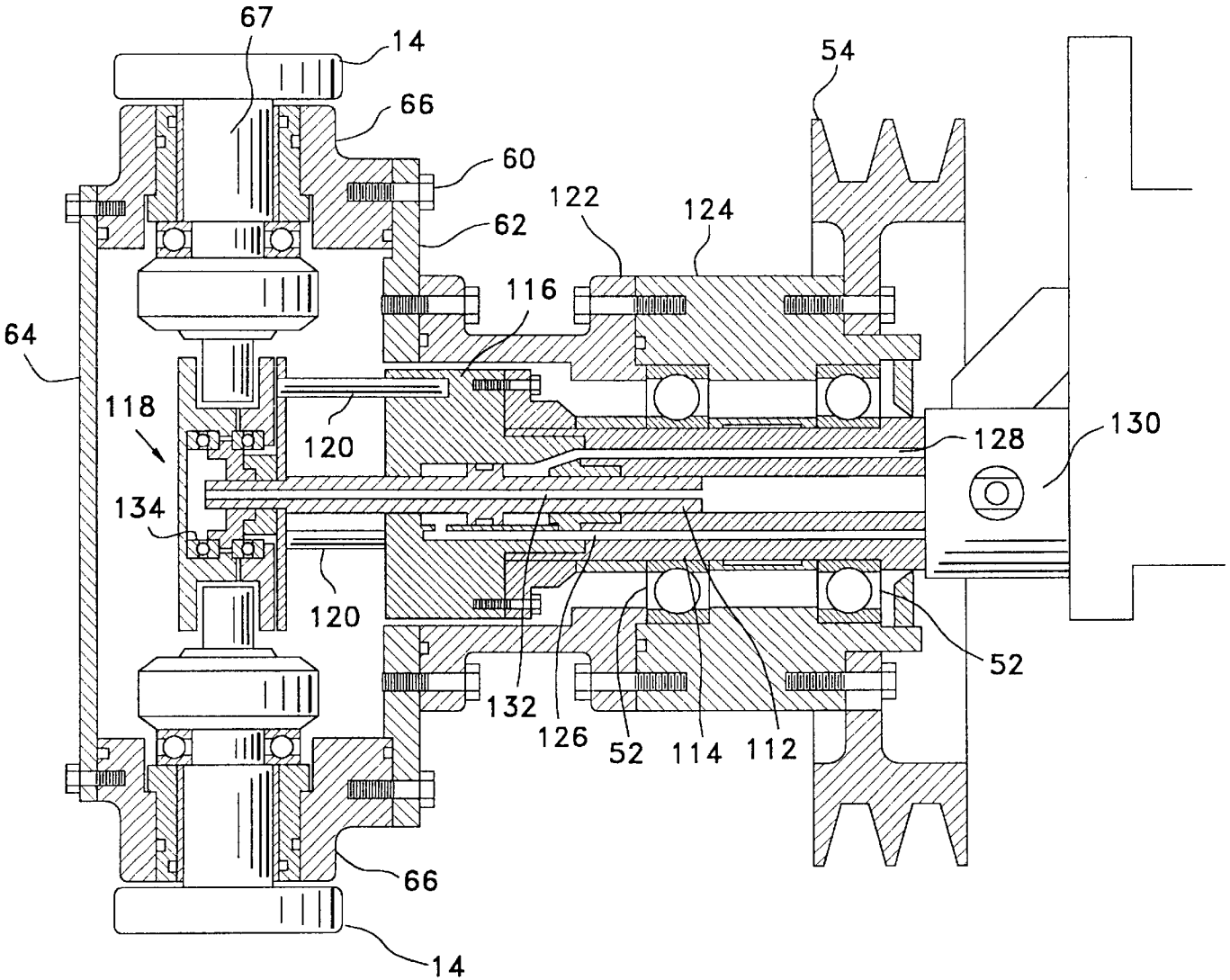
FIG. 8 is a section through a hydraulically actuated variable pitch fan with stationary cylinder.
Figure 6:
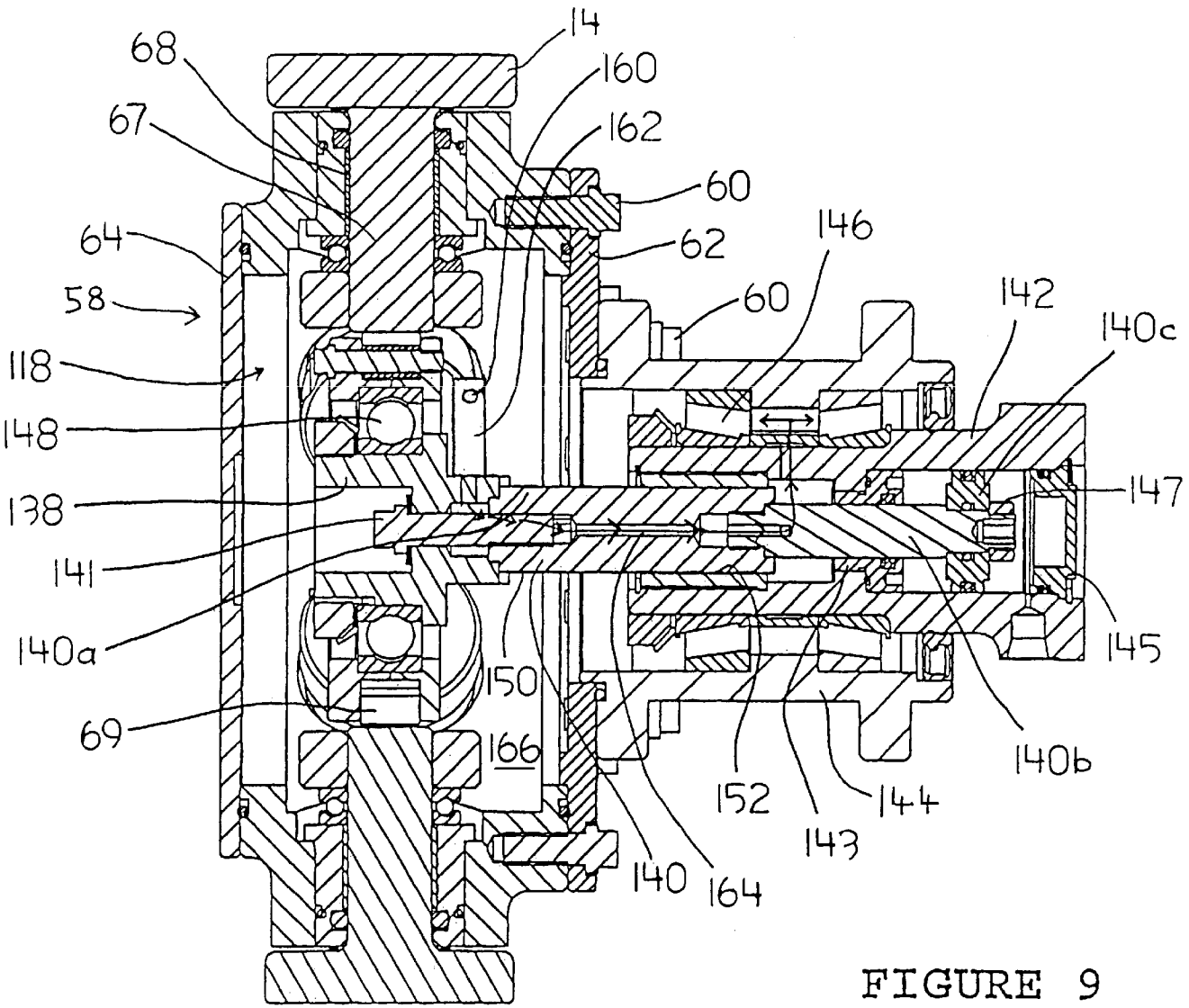

Referring now to FIG. 8, an embodiment is shown in which the piston 112 is axially movable within a bore formed in main shaft 114. A stationary cylinder 116 is fixed to the main shaft 114. In this instance, the pitch shifter 118 is attached to the piston, and stabilized with pins 120 that extend from the pitch shifter 118 to the cylinder 116. In this case, the cylindrical housing to which the pulley hub 54 and fan hub 66 is attached is formed of two parts 122 and 124. In addition, hydraulic fluid is supplied through channel 126 from the pitch actuator 16 to move the piston to the right in the figure and through channel 128 to move the piston the left in the figure. Grease may be supplied to the pitch shifter bearings 134 through a channel 132 running along the axis of the piston 112. Grease and hydraulic fluid may be fed to the respective channels through fitting 130. Otherwise, the parts of the embodiment shown in FIG. 8 function in the same manner as the embodiment shown in FIGS. 3 and 4.

Figure 9A:
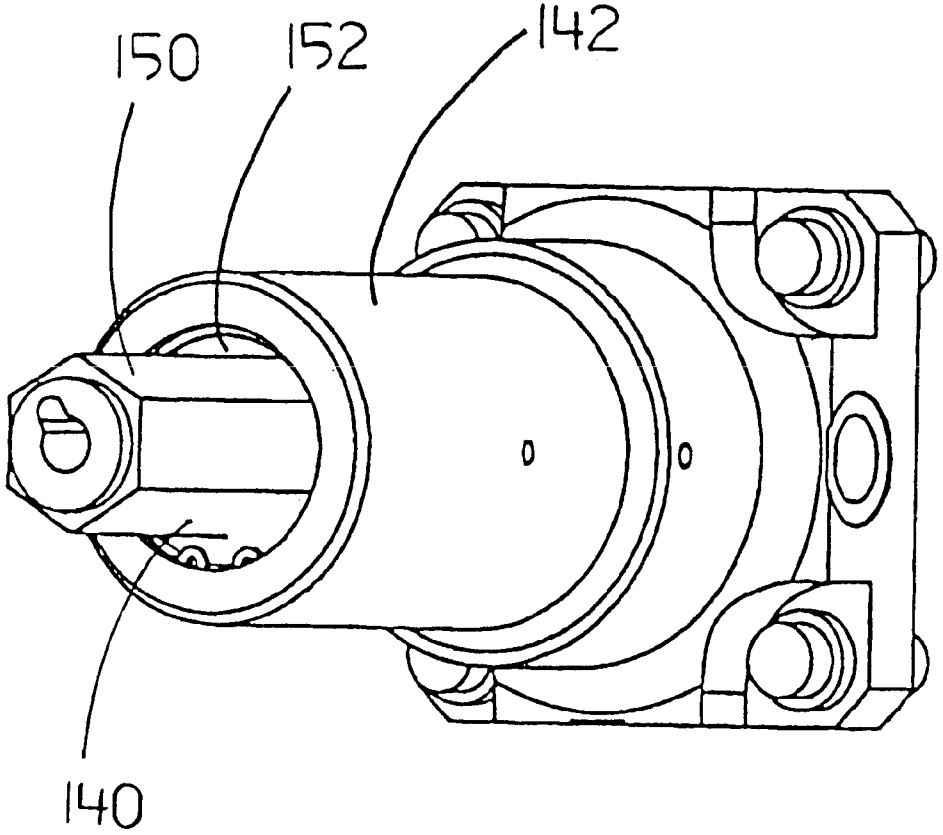
FIG. 9A is a perspective view of the hexagonal piston shaft of FIG. 9.

A preferred manner of securing the cylinder and piston against relative rotational movement according to the invention is shown in FIGS. 9 and 9A. In FIGS. 9 and 9A, the fan hub 58, fan blades 14 and pitch shifter 118 have the same construction as the fan shown in FIG. 8, and are to be used in conjunction with the same pulley hub 54 shown in FIG. 8. In the example of FIGS. 9 and 9A, piston shaft 140 is axially movable within a bore formed in main shaft 142. The piston shaft 140 is made of three main sections: hex shaft 140*a*, extension shaft 140*b*, and piston 140*c*, each axially aligned. Pitch shifter connector 138 and hex shaft 140*a* are secured together by a bolt 141. Hex shaft 140*a* and extension shaft 140*b* are threaded together. Piston 140*c*, which seals against the interior surface of the main shaft 142 is held on extension shaft 140*b* by a nut 147. The bore in main shaft 142 is closed by respective end caps 142 and 145. Hydraulic fluid is supplied to either side of the piston 140*c* through ports in the main shaft 142 from the pitch actuator 16 shown in FIG. 1.

The main shaft 142 acts as a stationary cylinder. Housing 144 is mounted on bearings 146 for rotation around the main shaft 142. Main shaft 142 is mounted to the engine of a vehicle in use, and the housing 144 rotates around the main shaft 142. As in FIG. 8, the pitch shifter 118 is attached to the piston shaft 140 by pitch shifter connector 138. It is desirable that relative rotational movement between the fan hub 58 and the piston 140 occurs at the bearings 148 in the pitch shifter 118, and thus that piston 140 be stationary relative to the main shaft 142. To achieve this, hex shaft portion 140*a* of piston shaft 140 has an out of round exterior surface 150, here shown as hexagonal in section, which is received within and engages a complementary out of round bore 152 in main shaft 142. The out of round bore 152 may be a cylindrical bore with stops which bear up against the ridges of the hexagonal surface 150. Other shapes for the out of round exterior surface 150 may be used. A hexagonal surface is simple to machine.

The out of round surface 150 forms a stop preventing relative rotational movement between the piston shaft 140 and the main shaft 142. Relative rotational movement may also be stopped in this manner between a moving cylinder and stationary piston.

A lubrication system for the fan assembly is also provided. Oil scoop 160 is fixed to pitch shifter connector 140*a*, and has an internal passageway 162 connecting with a channel 164 passing through hex shaft 140*b*, shaft extension 140*c* and main shaft 142 to bearings 146. As the fan hub 58 rotates, oil in the cavity 166 forms a reservoir on the outer periphery of the cavity 166, which rotates with the fan hub 58. The scoop 160 extends into the reservoir and the oil flows along the passageway 162 to the bearings 146.

A person skilled in the art could make immaterial modifications to the invention described here without departing from the essence of the invention.

The embodiments of the invention in which an exclusive property or privilege is claimed are defined as follows:

1. A variable pitch fan; configured to operate with a main shaft having an axis, comprising:

a housing and fan hub mounted for rotation together on the main shaft;

a plurality of fan blades mounted with adjustable pitch on the fan hub;

one of a piston shaft and a cylinder extending axially from the main shaft;

a pitch shifter mounted on one of the cylinder and the piston shaft, the pitch shifter interconnecting the one of the cylinder and the piston shaft and the fan blades to convert axial movement of the one of the cylinder and the piston shaft to a pitch change of the fan blades; and a stop preventing relative rotational movement between the piston shaft and cylinder.

2. The variable pitch fan of claim 1 in which the stop is formed by an out of round surface on at least one of the piston shaft and cylinder.

3. The variable pitch fan of claim 2 in which the main shaft has a bore defining the cylinder, and the out of round exterior surface on the piston shaft is received by an out of round surface in the main shaft.

4. The variable pitch fan of claim 3 in which the housing is mounted for rotational movement on the main shaft on bearings, and lubrication for the bearings is delivered by a passageway through the piston shaft.

5. The variable pitch fan of claim 2 in which the out of round surface is hexagonal in cross section.

6. The variable pitch fan of claim 2 in which the piston shaft has an exterior surface and the cylinder has an interior surface and each of the exterior surface and interior surface is out of round.

7. The variable pitch fan of claim 2 in which the piston shaft has a hexagonal exterior surface for engaging a surface on the cylinder.

8. The variable pitch fan of claim 1 in which a portion of the main shaft forms the other of the piston shaft and cylinder.

9. The variable pitch fan of claim 1 further comprising a pulley hub mounted together with the housing for rotation on the main shaft.

10. A variable pitch fan, comprising:

a fan hub;

a plurality of fan blades mounted with adjustable pitch on the fan hub;

a pitch shifter mechanism mounted on the fan hub and interconnecting with the fan blades to effect pitch adjustment of the fan blades; and counterweights mounted on each fan blade in a position which generates a torque opposite in direction to torque generated by the fan blades.

11. The variable pitch fan of claim 10 in which each fan blade has a chord and the counterweights are mounted perpendicular to the chord.

12. The variable pitch fan of claim 10 in which the counterweights underbalance the blades.

13. The variable pitch fan of claim 10 in which the counterweights balance the blades.

14. The variable pitch fan of claim 10 in which the counterweights overbalance the blades.

* * * * *